US008704734B2

(12) United States Patent
Wu et al.

(10) Patent No.: US 8,704,734 B2
(45) Date of Patent: Apr. 22, 2014

(54) DIGIT DISPLAY

(75) Inventors: Wei-Ting Wu, New Taipei (TW); Wen-Chieh Huang, New Taipei (TW); Yao-Wen Hsiao, New Taipei (TW)

(73) Assignee: Everlight Electronics Co., Ltd. (TW)

( * ) Notice: Subject to any disclaimer, the term of this patent is extended or adjusted under 35 U.S.C. 154(b) by 388 days.

(21) Appl. No.: 13/115,086

(22) Filed: May 24, 2011

(65) Prior Publication Data

US 2012/0098735 A1 Apr. 26, 2012

(30) Foreign Application Priority Data

Oct. 22, 2010 (TW) ..... 99136140 A

(51) Int. Cl.
*G09G 3/14* (2006.01)

(52) U.S. Cl.
USPC ..... 345/46; 345/33

(58) Field of Classification Search
None
See application file for complete search history.

(56) References Cited

U.S. PATENT DOCUMENTS

| | | | | |
|---|---|---|---|---|
| D118,059 | S | 12/1939 | Shernov | |
| 3,008,065 | A | 11/1961 | Chamberlin | |
| D198,606 | S | 7/1964 | Dickson | |
| D198,607 | S | 7/1964 | Dickson | |
| 3,273,270 | A | 9/1966 | Skrobisch | |
| 3,485,168 | A | 12/1969 | Martinson | |
| 4,672,759 | A | 6/1987 | Docherty et al. | |
| D298,146 | S | 10/1988 | Glover | |
| 6,088,008 | A * | 7/2000 | Reeder | 345/33 |
| 6,212,807 | B1 | 4/2001 | Wright | |
| 6,617,786 | B1 * | 9/2003 | Centofante | 313/512 |
| 6,829,852 | B1 | 12/2004 | Uehran | |
| 7,468,710 | B2 | 12/2008 | Nakaoka | |
| 7,845,839 | B2 | 12/2010 | Collier | |
| 2005/0073473 | A1 * | 4/2005 | Carpinelli et al. | 345/39 |
| 2005/0104803 | A1 * | 5/2005 | Tuason | 345/33 |
| 2009/0117807 | A1 * | 5/2009 | Uno et al. | 445/3 |
| 2009/0168398 | A1 | 7/2009 | Collier | |
| 2011/0050735 | A1 * | 3/2011 | Bae et al. | 345/690 |

FOREIGN PATENT DOCUMENTS

| | | |
|---|---|---|
| JP | A1972027425 | 10/1972 |
| JP | A1977153623 | 12/1977 |
| JP | U1979117082 | 8/1979 |
| JP | 1981-80567 | 6/1981 |
| JP | 1981-165185 | 12/1981 |
| JP | 56165185 | 12/1981 |
| JP | 1982-96482 | 6/1982 |

(Continued)

OTHER PUBLICATIONS

U.S. Appl. No. 29/366,780, filed Jul. 29, 2010; inventors: Wu, Wei-Ting; Huang, Wen-Chieh; Hsiao, Yao-Wen.

*Primary Examiner* — Joseph Haley
*Assistant Examiner* — Emily Frank
(74) *Attorney, Agent, or Firm* — Han IP Corporation

(57) ABSTRACT

Various embodiments of a digit display are provided. In one aspect, a digit display comprises at least one display unit. The at least one digit unit comprises twenty-eight character segments that are arranged in a manner including a quadrilateral, a cross, and four X-shaped arrangements. The quadrilateral is formed by eight of the twenty-eight character segments with two character segments on each of four sides of the quadrilateral. The cross is formed by four of the twenty-eight character segments and dividing the quadrilateral into four quadrants. Each of the four X-shaped arrangements is disposed in a respective one of the four quadrants and formed by respective four of the twenty-eight character segments.

18 Claims, 8 Drawing Sheets

(56) References Cited

FOREIGN PATENT DOCUMENTS

| | | |
|---|---|---|
| JP | 5796482 | 6/1982 |
| JP | 1987-2287 | 1/1987 |
| JP | U1989023086 | 2/1989 |
| JP | 11-135839 | 5/1999 |
| JP | 2001-332771 | 11/2001 |
| JP | 2001332771 | 11/2001 |
| JP | 2002-170078 | 6/2002 |
| JP | 2008-251604 | 10/2008 |
| JP | 2009-025778 | 2/2009 |
| JP | D1365597 | 7/2009 |
| JP | 2010-204441 | 9/2010 |
| TW | 576541 | 2/2004 |
| TW | 200635067 | 10/2006 |
| WO | WO2005029452 | 3/2005 |

* cited by examiner

DIGIT DISPLAY

CROSS-REFERENCE TO RELATED APPLICATIONS

This application claims the priority benefit of Taiwan Patent Application Number 099136140, filed Oct. 22, 2010, which is herein incorporated in its entirety by reference.

BACKGROUND

1. Technical Field

The present disclosure relates to a digit display with multiple character segments as one display unit. More particularly, the present disclosure relates to a digit display with a display unit having twenty-eight character segments that can display at least the digits 0~9 and/or the alphabets A~Z.

2. Description of Related Art

The way that digit displays display Arabic numerals (hereinafter interchangeably referred to as "numerals" and "digits"), English alphabets (hereinafter referred to as "alphabets") or symbols (numerals, digits, alphabets and symbols together hereinafter referred to as "characters") is typically by turning on/off light-emitting components of character segments that make up display units.

From the past to the present, the characters displayed mainly tend to be capitalized alphabets and digits. FIG. 1A shows a conventional dot-array display 100 with an array of dots. FIG. 1B shows a digit display 200 that is specifically used to display alphabets.

In the dot-array display 100 of FIG. 1A, there are thirty-five light-emitting dots 101. Operation of the light-emitting dots can be controlled by a peripheral circuit to be respectively turned on or off to allow an observer to observe an alphabet or a digit being displayed. However, as the number of light-emitting dots to be controlled tends to be large, the peripheral circuit tends to be complicated and hence resulting in higher costs. In the digit display 200 of FIG. 1B, there are twelve character segments 201 in one display unit. Although alphabets can be displayed, it is difficult to discern certain alphabets (such as "B", "D", "G", "O", etc.) from other alphabets based on what is being displayed. Besides, there is also the issue that numerals cannot be displayed by the digit display 200.

FIG. 2 shows a digit display 300, with seven character segments, which is a type of digit display commonly seen on the market. As shown, the digit display 300 has seven character segments 301 that can display numerals, as shown in Table 1 below, as well as the twenty-six English alphabets.

TABLE 1

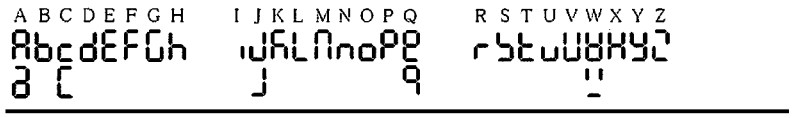

However, as shown in Table 1, some of the alphabets tend to hard to discern (such as "K", "M", "N", "Q", "R", "T", "U", "V", "VV", "X" and "Z"), not to mention appearing to be confusingly similar to certain numerals. For example, the displayed alphabet "B" and the numeral "6" are confusingly similar. Likewise, the displayed alphabet "O" and the numeral "0", the displayed alphabet "Q" and the numeral "9", the displayed alphabet "S" and the numeral "5", and the displayed alphabet "Z" and the numeral "2" are also confusingly similar.

SUMMARY

The present disclosure aims to address the aforementioned issued with conventional techniques by providing a digit display that can clearly and discernably display alphabets, symbols and numerals (including Arabic numerals and Chinese numerals). As a circuit for an existing digit display can be used for the digit display according to the present disclosure, not only the costs need not be higher but the integration of the apparatus and the circuit can be simplified.

In one aspect, a digit display may comprise at least one display unit. The at least one digit unit may comprise twenty-eight character segments that may be arranged in a manner including a quadrilateral, a cross, and four X-shaped arrangements. The quadrilateral may be formed by eight of the twenty-eight character segments with two character segments on each of four sides of the quadrilateral. The cross may be formed by four of the twenty-eight character segments and dividing the quadrilateral into four quadrants. Each of the four X-shaped arrangements may be disposed in a respective one of the four quadrants and formed by respective four of the twenty-eight character segments.

In one embodiment, the quadrilateral may comprise one of a square, a rectangle, an oblong, a trapezoid, a rhombus, a rhomboid, or a polygon with four unequal sides.

In one embodiment, the at least one display unit may further comprises a substrate, a reflective cap layer disposed on the substrate, a plurality of light-emitting components, and a plurality of sealant members. The reflective cap layer may comprise a plurality of recesses to expose portions of the substrate, where contours of the recesses may form the character segments. Each of the light-emitting components may be disposed in a respective one of the recess of the reflective cap layer and electrically coupled to the substrate. The plurality of sealant members may be made of a transparent material, and each of the sealant members may be disposed in a respective one of the recesses of the reflective cap layer to seal the respective light-emitting component.

In one embodiment, the substrate may comprise a printed circuit board (PCB), a ceramic substrate, or a metallic lead frame.

In one embodiment, the light-emitting components may comprise light-emitting diode (LED) chips.

In one embodiment, at least one of the recesses of the reflective cap layer may have one or more of the LED chips disposed therein.

In one embodiment, a cross-sectional shape of each of the recesses may be a trapezoidal shape or funnel-shaped.

In one embodiment, a material of the sealant members may comprise epoxy or silicone.

In one embodiment, a material of the reflective cap layer may comprise PPO or PPA.

In one embodiment, the substrate may comprise a plurality of through holes configured to receive a plurality of electrically conductive pins.

In another aspect, a digit display may comprise at least one display unit comprising twenty-eight character segments that are arranged in a manner such that the twenty-eight character segments, when selectively turned on or off, display one of an English alphabet, an Arabic numeral, or a Chinese numeral.

In one embodiment, the twenty-eight character segments may be arranged in a manner including: a quadrilateral formed by eight of the twenty-eight character segments with two character segments on each of four sides of the quadrilateral; a cross formed by four of the twenty-eight character segments and dividing the quadrilateral into four quadrants; and four X-shaped arrangements each of which disposed in a respective one of the four quadrants and formed by respective four of the twenty-eight character segments.

In one embodiment, the quadrilateral may comprise one of a square, a rectangle, an oblong, a trapezoid, a rhombus, a rhomboid, or a polygon with four unequal sides.

In one embodiment, the at least one display unit may further comprise a substrate, a reflective cap, a plurality of light-emitting components, and a plurality of sealant members. The reflective cap layer may be disposed on the substrate and may comprise a plurality of recesses to expose portions of the substrate, where contours of the recesses may form the character segments. Each of the light-emitting components may be disposed in a respective one of the recesses of the reflective cap layer and electrically coupled to the substrate. Each of the sealant members may be disposed in a respective one of the recesses of the reflective cap layer to seal the respective light-emitting component.

In one embodiment, the substrate may comprise a printed circuit board (PCB), a ceramic substrate, or a metallic lead frame.

In one embodiment, the light-emitting components may comprise light-emitting diode (LED) chips. At least one of the recesses of the reflective cap layer may have one or more of the LED chips disposed therein.

In one embodiment, a cross-sectional shape of at least one of the recesses may be a trapezoidal shape or funnel-shaped.

In one embodiment, a material of the sealant members may comprise epoxy or silicone.

In one embodiment, a material of the reflective cap layer comprises PPO or PPA.

In one embodiment, the substrate may comprise a plurality of through holes configured to receive a plurality of electrically conductive pins.

Accordingly, a digit display according to embodiments of, the present disclosure can resolve issues such as small and capitalized alphabets not being displayed clearly, confusing similarity between alphabets and Arabic numerals, etc. The disclosed digit display can clearly and distinctly display alphabets, symbols and numbers, even including Chinese numerals.

In order to make the above and other objects, features and advantages of the present disclosure more comprehensible, several embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF PREFERRED EMBODIMENTS

The following description relates to various embodiments of a digit display of the present disclosure. However, these embodiments are for illustrative purpose and shall not be construed to limit the scope of the present disclosure.

Figure 1A:
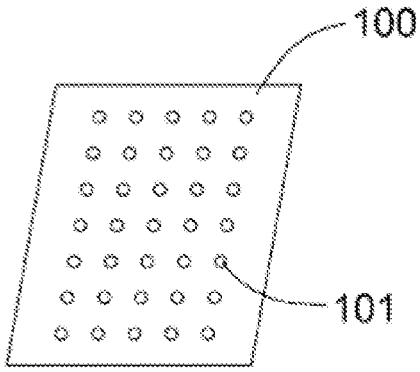
FIG. 1A (PRIOR ART)
FIG. 1A is a planar view of a conventional light-emitting display device.
Figure 1B:
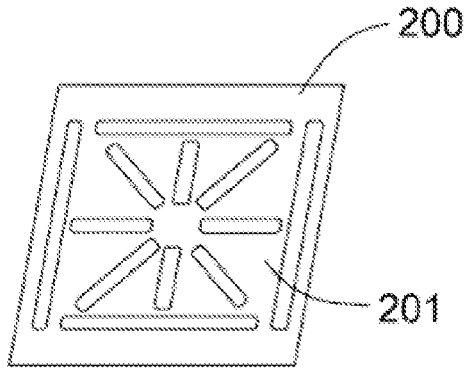
FIG. 1B (PRIOR ART)
FIG. 1B is a planar view of another conventional light-emitting display device.
Figure 2:
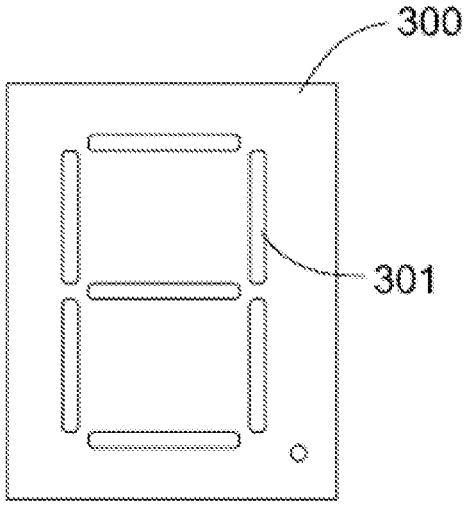
FIG. 2 (PRIOR ART)
FIG. 2 is a planar view of a yet another conventional light-emitting display device.
Figure 3:
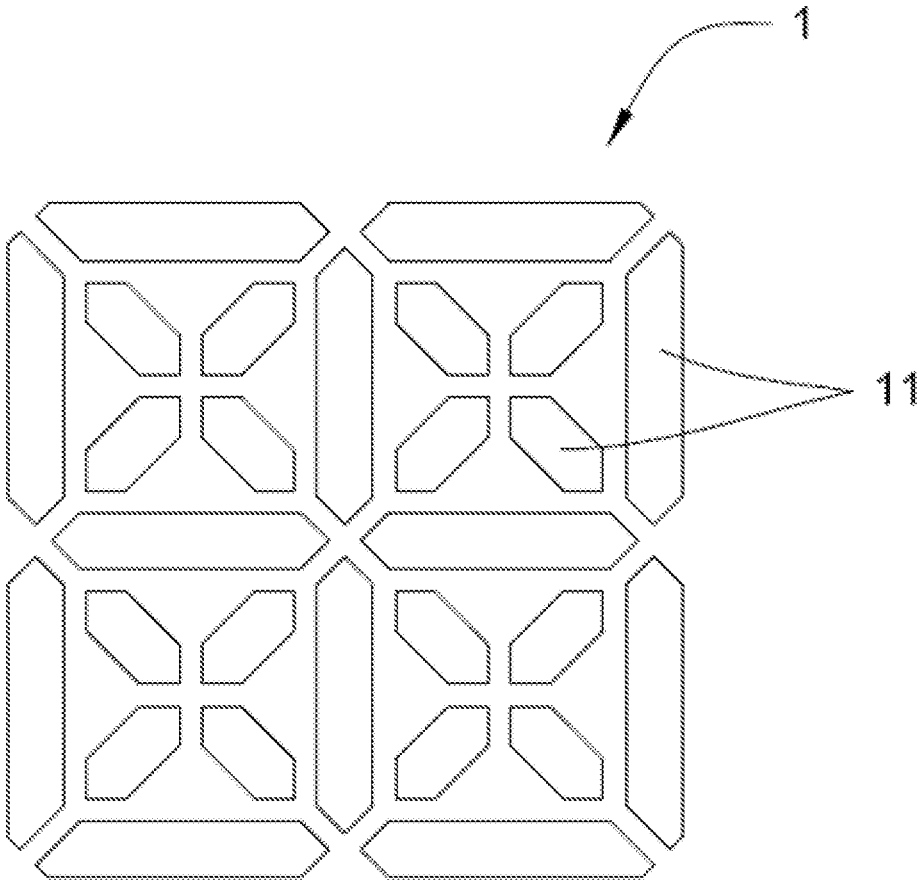
FIG. 3 is a planar view of a display unit of a digit display in accordance with an embodiment of the present disclosure.
Figure 4:
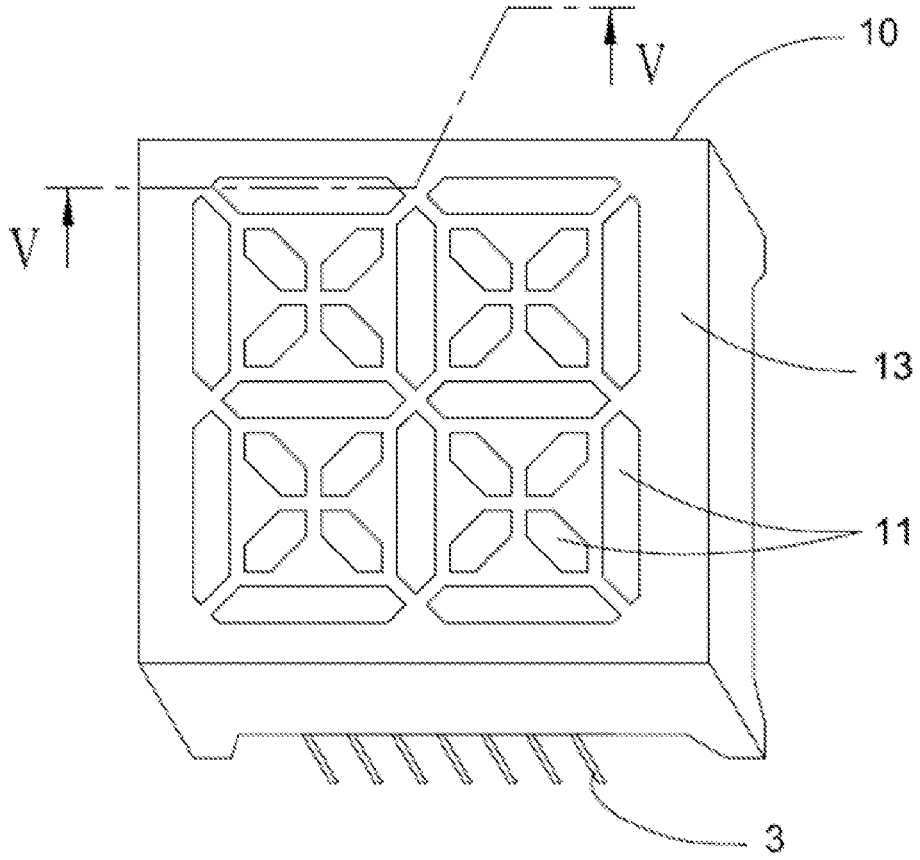
FIG. 4 is a three-dimensional view of a digit display in accordance with an embodiment of the present disclosure.
Figure 10:
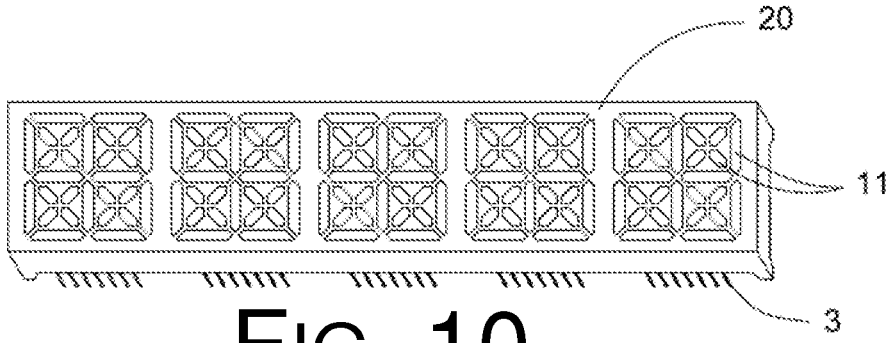
FIG. 10 is a three-dimensional view of another digit display in accordance with an embodiment of the present disclosure.

Referring to FIG. 3, which illustrates a planar view of a display unit 1 of a digit display in accordance with an embodiment of the present disclosure. In one embodiment, each display unit 1 comprises twenty-eight character segments 11, while a digit display may comprise one or more display units. The actual quantity of display units in a digit display can be adjusted depending on the application. FIG. 4 illustrates a digit display 10 with a display unit. A user can use various combinations of such a digit display for various applications, such as that shown in FIG. 10 which includes a digit display 20 with multiple display units.

As shown in FIG. 4, the display unit has twenty-eight character segments. The twenty-eight character segments comprise a quadrilateral with two character segments forming each of the four sides, and a cross formed by four character segments and dividing the quadrilateral into four quadrants. There are four X's each of which located in a respective one of the four quadrants and formed by four character segments. In various embodiments, the quadrilateral may be a square, a rectangle, an oblong, a trapezoid, a rhombus, a rhomboid, or a polygon with four unequal sides.

Figure 11A:
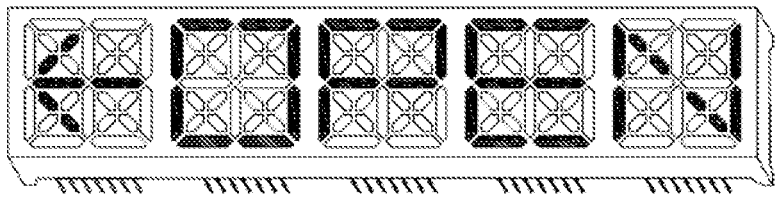
FIGS. 11A and 11B show a digit display in operation in accordance with an embodiment of the present disclosure.
Figure 11B:
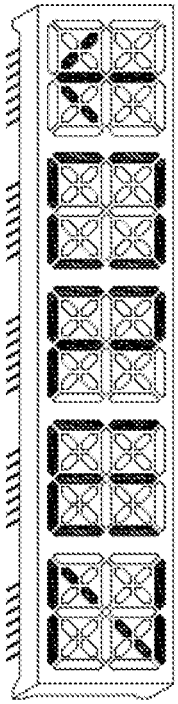

In one embodiment, the display unit is non-directional and thus may be disposed vertically or horizontally. FIG. 11A illustrates the digit display 20 being disposed horizontally. FIG. 11B illustrates the digit display 20 being disposed vertically.

Figure 5:
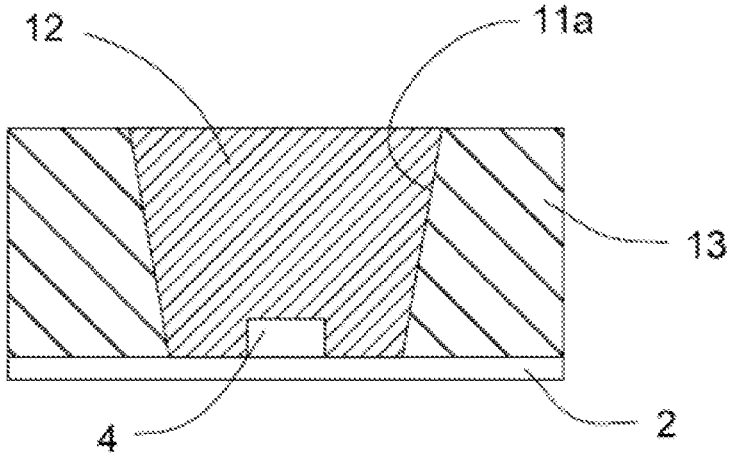
FIG. 5 is a cross-sectional view of the digit display of FIG. 4 along line V-V.

FIGS. 4 and 5 illustrate a basic structure of a digit display in accordance with the present disclosure. In particular, FIG. 4 illustrates a three-dimensional view of a digit display in accordance with an embodiment of the present disclosure, and FIG. 5 illustrates a cross-sectional view of the digit display of FIG. 4 along line V-V.

Referring to FIGS. 4 and 5, the digit display 10 comprises a substrate 2, a light-emitting component 4 disposed on one side of the substrate 2, a reflective cap layer 13 having one or more recesses 11*a*, and a sealant member 12. In the event that the light-emitting component 4 is a surface mount device, the light-emitting component 4 is directly affixed on or otherwise attached to the substrate 2. In the event that the light-emitting component 4 is a light-emitting diode (LED), wire bonding is utilized to electrically couple the light-emitting component 4 with electrodes on the substrate 2. In various embodiments, the substrate 2 may be a printed circuit board (PCB), a ceramic substrate, or a metallic lead frame. In various embodiments, the sealant member 12 may be epoxy or silicone.

Pins 3, through which the character segments are actuated on or off, are affixed on or otherwise attached to the substrate 2. The substrate 2, with the light-emitting component 4 affixed thereon, is coupled with the reflective cap layer 13 in any suitable fashion so long as the light-emitting component 4 is situated in the recess 11*a*. The pins 3 need not be in a needle-like shape as shown in FIG. 4, but may be bent or may be in a spherical form or in a form as electrode pieces.

Afterwards, the transparent sealant member 12 is filled into the recess 11*a* of the reflective cap layer 13. The reflective cap layer 13 is made of an opaque material and is disposed on the substrate 2 to surround or otherwise enshroud the light-emitting component 4. When the reflective cap layer 13 has a plurality of recesses 11*a*, contours of the plurality of recesses 11*a* form the character segments 11 of the display unit 1 when observed from an observing side. To promote efficient illumination, the cross-sectional shape of the recess 11*a* is a trapezoidal shape or funnel-shaped as shown in FIG. 5. In one embodiment, the light-emitting component 4 is an LED chip. To allow adjustment of the color of the emitted light, one or more light-emitting components 4 may be disposed in each recess 11*a*. In one embodiment, when the light-emitting component 4 comprises a blue-light LED chip, the transparent sealant member 12 may be doped with yellow phosphor so that white light can be emitted when blue light excites the yellow phosphor. In another embodiment, when the light-emitting component 4 comprises three RGB (red, green, blue) LED chips, white light or light of other colors can be produced by mixing the emitted lights. In such case there is no need to dope the transparent sealant member 12 with yellow phosphor.

After the substrate 2 and the reflective cap layer 13 are coupled together and the sealant member 12 filled in, a baking process is carried out to solidify the sealant member 12. The sealant member 12, used to seal the light-emitting component 4, comprises a suitable transparent material such as, for example, epoxy or silicone. In various embodiments, the material of the reflective cap layer 13 may be polyphenylene oxide (PPO) or polyphthalamide (PPA).

In one embodiment, the substrate 2 may be a PCB or a ceramic substrate, and hence pins 3 are needed to transmit and receive electrical signals for control. Alternatively, the substrate 2 may be a metallic lead frame. When the chip is disposed on the lead frame electrical signals can pass through the lead frame for control, and thus there would be no need of the pins 3.

Figure 6:
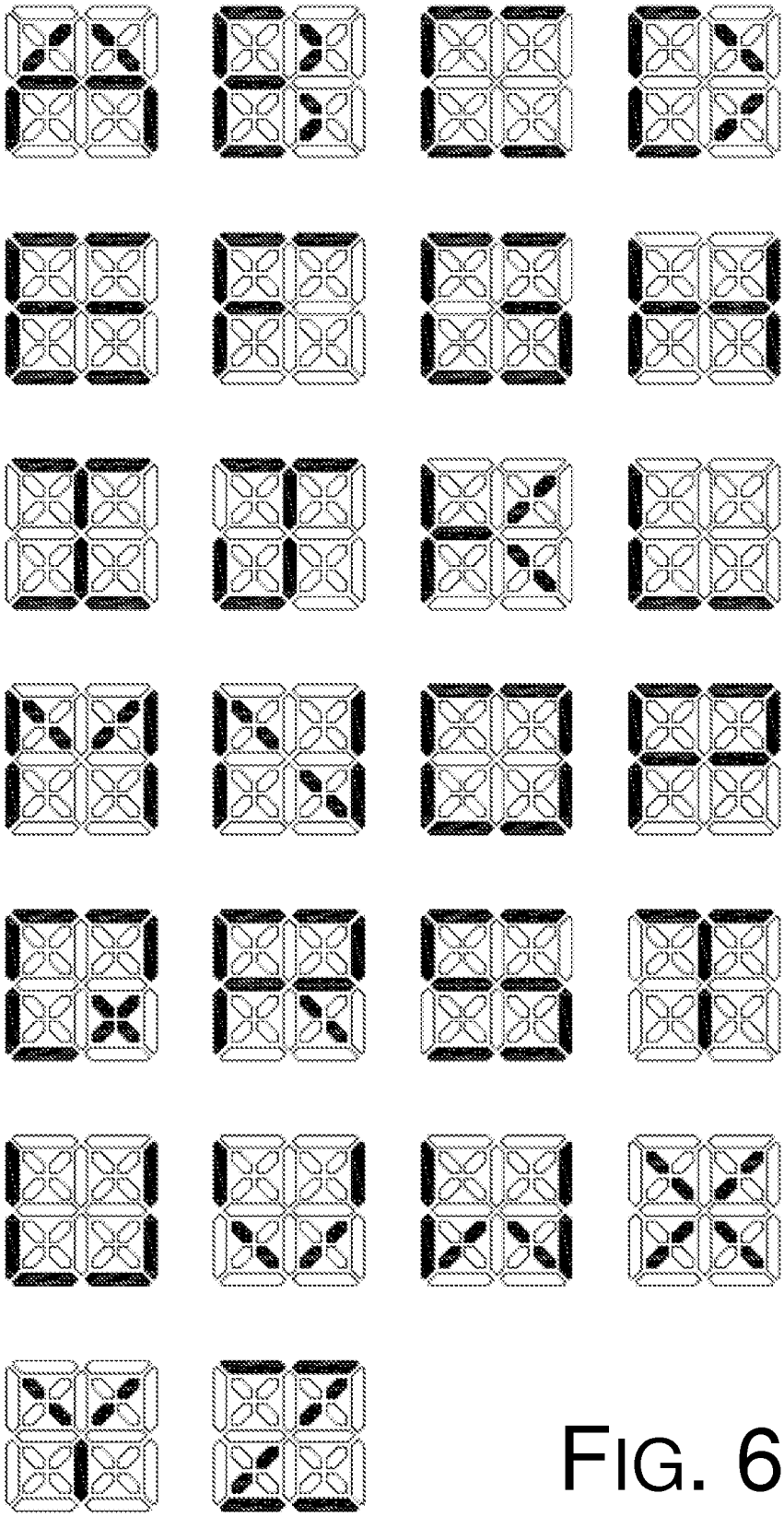
FIG. 6 is a diagram of alphabets being displayed by display units of a digit display in accordance with an embodiment of the present disclosure.
Figure 7:
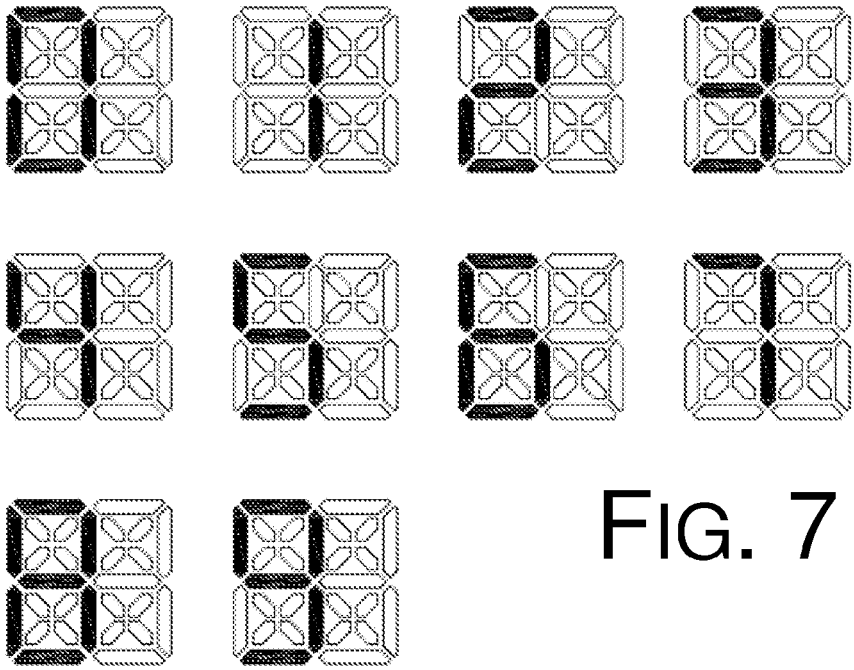
FIG. 7 is a diagram of Arabic numerals 0 through 9 displayed by display units of a digit display in accordance with an embodiment of the present disclosure.
Figure 8:
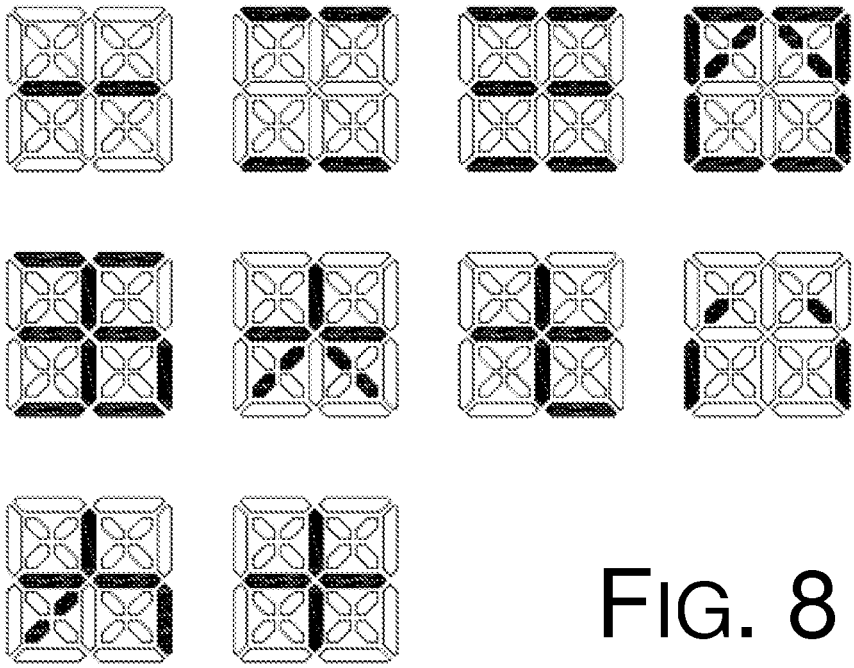
FIG. 8 is a diagram of Chinese numerals zero through ten displayed by display units of a digit display in accordance with an embodiment of the present disclosure.

FIG. 6 is a diagram of alphabets being displayed by display units of a digit display in accordance with an embodiment of the present disclosure. FIG. 7 is a diagram of Arabic numerals 0 through 9 displayed by display units of a digit display in accordance with an embodiment of the present disclosure. FIG. 8 is a diagram of Chinese numerals zero through ten displayed by display units of a digit display in accordance with an embodiment of the present disclosure.

Figure 9A:
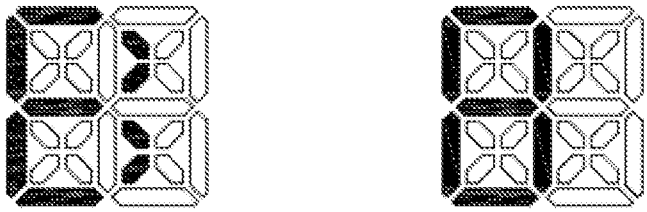
FIGS. 9A through 9C show comparisons of certain alphabets and numerals displayed by display units of a digit display in accordance with an embodiment of the present disclosure.
Figure 9B:
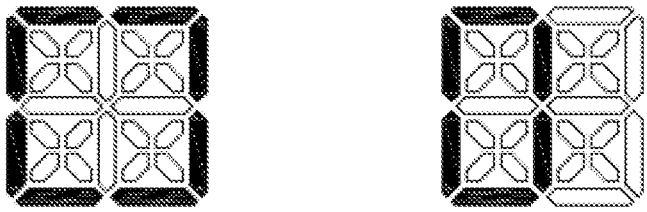
Figure 9C:
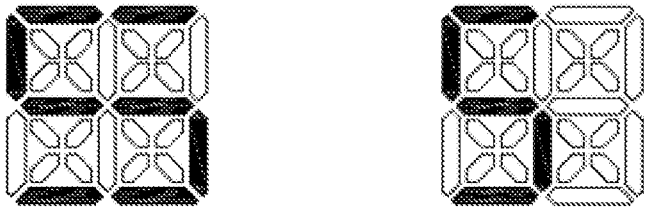

It can be seen from these figures that each display unit of a digit display of some embodiments of the present disclosure can flexibly adjust the portion of the respective display unit that is actually illuminating depending on whether an alphabet, Arabic numeral, or Chinese numeral that is being displayed. For example, when displaying an alphabet or a Chinese numeral the entire light-emitting portion of the display unit is used to display the character, and when displaying an Arabic numeral half of the light-emitting portion of the display unit is used to display the character. This resolves the issue of alphabets and Arabic numerals being confusingly similar associated with conventional techniques. Moreover, each display unit of a digit display of some embodiments of the present disclosure comprises twenty-eight character segments that can be controlled to illuminate as various combinations to display characters. This not only resolves the issue of alphabets displayed by conventional techniques not being aesthetically appealing, but also allows more symbols or characters to be displayed such as, for example, the Chinese numerals shown in FIG. 8 or the arrow symbol shown in FIG. 11. FIG. 9A shows a comparison of the display of the alphabet "B" and the Arabic numeral "8" in accordance with embodiments of the present disclosure. With twenty-eight character segments in each display unit, not only the displayed alphabet "B" and the displayed Arabic numeral "8" are clearly distinguishable from one another but the displayed alphabets also tend to be more aesthetically appealing. FIG. 9B shows a comparison of the display of the alphabet "O" and the Arabic numeral "0" in accordance with embodiments of the present disclosure. By utilizing the entire light-emitting portion of the display unit to display an alphabet or a Chinese numeral but utilizing half of the light-emitting portion of the display unit to display an Arabic numeral, the difficulty for a user to distinguish an alphabet "O" and an Arabic numeral "0" as displayed by a conventional digit display can be avoided. FIG. 9C shows a comparison of the display of the alphabet "S" and the Arabic numeral "5" in accordance with embodiments of the present disclosure. Under the above-described concept, the difficulty for a user to distinguish an alphabet "S" and an Arabic numeral "5" as displayed by a conventional digit display can be avoided.

Figure 12A:
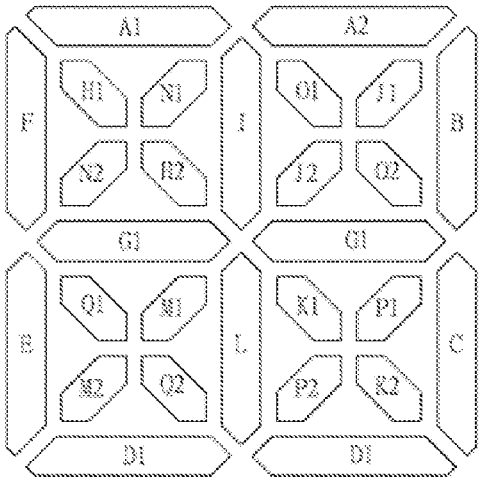
FIG. 12A shows labeling of character sections of a display unit of a digit display in accordance with an embodiment of the present disclosure.
Figure 12B:
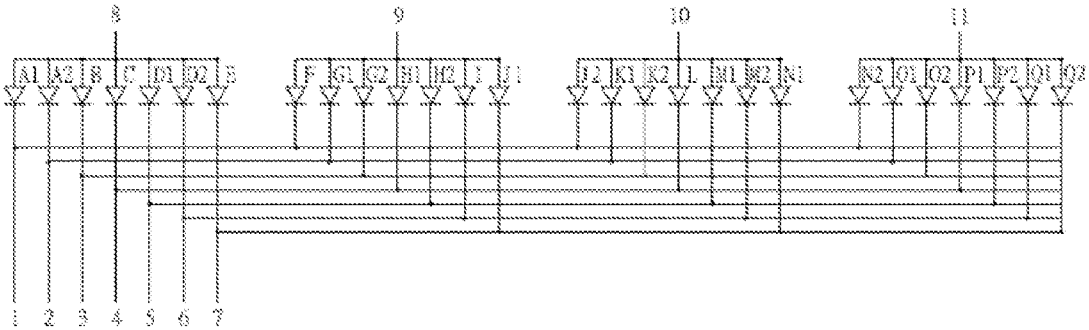
FIG. 12B is a schematic diagram of a technique to actuate a digit display in accordance with an embodiment of the present disclosure.

A description of an actuation mechanism for a digit display in accordance with embodiments of the present disclosure will now be provided with reference to FIGS. 12A and 12B. FIG. 12A shows labeling of character sections of a display unit of a digit display in accordance with an embodiment of the present disclosure. FIG. 12B is a schematic diagram of a technique to actuate a digit display in accordance with an embodiment of the present disclosure.

In the actuation technique illustrated in FIG. 12B, a plurality of pins, such as eleven pins, are utilized to conduct electricity to allow controlling of a conducted electrical signal. The shape and form of the pins do not need to be needle-like, and can be for example spherical-like, in the form of electrode pieces, etc. The sequence numbers shown in FIGS. 12A and 12B are for the convenience of description and shall not be construed to limit the position or sequence of the numbering to that shown.

As shown in FIG. 12A, the twenty-eight character segments of a display unit of a digit display of embodiments of the present disclosure are labeled and arranged as A1, A2, B, C, D1, D2, E, F, G1, G2, H1, H2, I, J1, J2, K1, K2, L, M1, M2, N1, N2, 01, 02, P1, P2, Q1 and Q2.

As shown in FIG. 12B, character segments A1, A2, B, C, D1 and D2 are arranged as a group controlled by pin 8, character segments F, G1, G2, H1, H2, I and J1 are arranged as a group controlled by pin 9, character segments J2, K1, K2, L, M1, M2 and N1 are arranged as a group controlled by pin 10, and character segments N2, O1, O2, P1, P2, Q1 and Q2 are arranged as a group controlled by pin 11. The numeral references 1 through 7 shown in FIG. 12B represent pin 1 through pin 7. By control the electrical signal flowing through these eleven pins the digit display of embodiments of the present disclosure can be controlled and actuated. Pins not related to actuation are shown in FIG. 12B, and a description of which is omitted in the interest of brevity.

As an example, the four character segments F, E, D1 and D2 shown in FIG. 12A are actuated when the alphabet "L" is displayed by a display unit of a digit display of embodiments of the present disclosure.

Referring to FIG. 12B, a process of actuation is provided below.

(a) The electrical polarity of pin 9 is changed from negative to positive, and the electrical polarity of pin 1 is changed from positive to negative. This allows a flow of electrical current to cause the character segment F to emit light.

(b) The electrical polarity of pin 8 is changed from negative to positive, and the electrical polarity of pin 7 is changed from positive to negative. This allows a flow of electrical current to cause the character segment E to emit light.

(c) The electrical polarity of pin 8 is changed from negative to positive, and the electrical polarity of pin 5 is changed from positive to negative. This allows a flow of electrical current to cause the character segment D1 to emit light.

(d) The electrical polarity of pin 8 is changed from negative to positive, and the electrical polarity of pin 6 is changed from positive to negative. This allows a flow of electrical current to cause the character segment D2 to emit light.

Based on the principle of persistence of vision for the human eye, the alphabet "L" can appear to be displayed by a display unit of a digit display of embodiments of the present disclosure by repeatedly carrying out the aforementioned operations (a) through (d) in a rather short period of time.

The above process of actuation is for illustrative purpose and the sequence of actuating the four character segments is an example. As the display unit of the digit display operates based on the principle of persistence of vision, the sequence in which pertinent character segments emit light may vary.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A digit display, comprising:

at least one display unit comprising twenty-eight character segments that are arranged in a manner including:

a quadrilateral formed by eight of the twenty-eight character segments with two character segments on each of four sides of the quadrilateral;

a cross formed by four of the twenty-eight character segments and dividing the quadrilateral into four quadrants; and four X-shaped arrangements each of which disposed in a respective one of the four quadrants and formed by respective four of the twenty-eight character segments, wherein each of the character segments comprises:

a substrate;

a reflective cap layer disposed on the substrate and comprising a recess to expose portions of the substrate, a contour of the recess forming the respective character segment;

a light-emitting component disposed in the recesses of the reflective cap layer and electrically coupled to the substrate; and a sealant member of a transparent material, the sealant member disposed in the recess of the reflective cap layer to seal the light-emitting component.

2. The digit display according to claim 1, wherein the quadrilateral comprises one of a square, a rectangle, an oblong, a trapezoid, a rhombus, a rhomboid, or a polygon with four unequal sides.

3. The digit display according to claim 1, wherein the substrate comprises a printed circuit board (PCB), a ceramic substrate, or a metallic lead frame.

4. The digit display according to claim 1, wherein the light-emitting components comprise light-emitting diode (LED) chips.

5. The digit display according to claim 4, wherein at least one of the recesses of the reflective cap layer has one or more of the LED chips disposed therein.

6. The digit display according to claim 1, wherein a cross-sectional shape of each of the recesses is a trapezoidal shape or funnel-shaped.

7. The digit display according to claim 1, wherein a material of the sealant members comprises epoxy or silicone.

8. The digit display according to claim 1, wherein a material of the reflective cap layer comprises polyphenylene oxide (PPO) or polyphthalamide (PPA).

9. The digit display according to claim 1, wherein the substrate comprises a plurality of through holes configured to receive a plurality of electrically conductive pins.

10. A digit display, comprising:

at least one display unit comprising twenty-eight character segments that are arranged in a manner such that the twenty-eight character segments, when selectively turned on or off, display one of an English alphabet, an Arabic numeral, or a Chinese numeral, wherein each of the character segments comprises:

a substrate;

a reflective cap layer disposed on the substrate and comprising a recess to expose portions of the substrate, a contour of the recess forming the respective character segment;

a light-emitting component disposed in the recesses of the reflective cap layer and electrically coupled to the substrate; and a sealant member of a transparent material, the sealant member disposed in the recess of the reflective cap layer to seal the light-emitting component.

11. The digit display according to claim 10, wherein the twenty-eight character segments are arranged in a manner including:

a quadrilateral formed by eight of the twenty-eight character segments with two character segments on each of four sides of the quadrilateral;

a cross formed by four of the twenty-eight character segments and dividing the quadrilateral into four quadrants; and four X-shaped arrangements each of which disposed in a respective one of the four quadrants and formed by respective four of the twenty-eight character segments.

12. The digit display according to claim 11, wherein the quadrilateral comprises one of a square, a rectangle, an oblong, a trapezoid, a rhombus, a rhomboid, or a polygon with four unequal sides.

13. The digit display according to claim 10, wherein the substrate comprises a printed circuit board (PCB), a ceramic substrate, or a metallic lead frame.

14. The digit display according to claim 10, wherein the light-emitting components comprise light-emitting diode (LED) chips, and wherein at least one of the recesses of the reflective cap layer has one or more of the LED chips disposed therein.

15. The digit display according to claim 10, wherein a cross-sectional shape of at least one of the recesses is a trapezoidal shape or funnel-shaped.

16. The digit display according to claim 10, wherein a material of the sealant members comprises epoxy or silicone.

17. The digit display according to claim 10, wherein a material of the reflective cap layer comprises polyphenylene oxide (PPO) or polyphthalamide (PPA).

18. The digit display according to claim 10, wherein the substrate comprises a plurality of through holes configured to receive a plurality of electrically conductive pins.

* * * * *